US005917284A

United States Patent [19]

Moore et al.

[11] Patent Number: 5,917,284

[45] Date of Patent: Jun. 29, 1999

[54] SPUTTER-RESISTANT CONDUCTIVE COATINGS WITH ENHANCED EMISSION OF ELECTRONS FOR CATHODE ELECTRODES IN DC PLASMA ADDRESSING STRUCTURE

[75] Inventors: John S. Moore; William W. Stein, both of Beaverton; Donald E. Kephart, Portland, all of Oreg.

[73] Assignee: Tektronix, Inc., Wilsonville, Oreg.

[21] Appl. No.: 08/904,154

[22] Filed: Jul. 31, 1997

Related U.S. Application Data

[63] Continuation-in-part of application No. 08/870,763, Jun. 6, 1997, Pat. No. 5,783,906, which is a continuation of application No. 08/520,996, Aug. 30, 1995, Pat. No. 5,536,817

[60] Provisional application No. 60/023,418, Aug. 16, 1996.

[51] Int. Cl.[6] ..... H01J 17/49

[52] U.S. Cl. ..... 313/586; 313/491; 313/584; 313/633; 445/51; 445/50

[58] Field of Search ..... 313/484, 582, 313/584, 585, 586, 587, 491, 633; 445/51, 50, 24; 315/169.1, 169.4

[56] References Cited

U.S. PATENT DOCUMENTS

| | | | |
|---|---|---|---|
| 3,716,742 | 2/1973 | Nakayama et al. | 313/587 |
| 4,340,840 | 7/1982 | Aboelfotoh et al. | 313/584 |
| 4,554,482 | 11/1985 | Kamegaya et al. | 313/582 |
| 4,599,076 | 7/1986 | Yokono et al. | 445/51 |
| 4,600,397 | 7/1986 | Kawakubo et al. | 445/50 |
| 4,703,225 | 10/1987 | Sohn | 313/585 |
| 5,428,263 | 6/1995 | Nagano | 313/585 |
| 5,783,906 | 7/1998 | Moore et al. | 313/586 |
| 5,808,408 | 9/1998 | Nakamoto | 313/484 |

OTHER PUBLICATIONS

Patent Abstracts Of Japan vol. 018, No. 586 (E–1627) Nov. 9, 1994, & JP Publication No. 06223725, Aug. 12, 1994 (Mitsubishi Electric Corp.).

*Primary Examiner*—Michael Day
*Attorney, Agent, or Firm*—John D. Winkelman; Paul S. Angello

[57] ABSTRACT

A conductive refractory compound coating for electrodes is sputter resistant, very resistant to oxidation, and easy to apply by way of electrophoresis or screen printing. This structure is further enhanced by the presence of surface particles of electrically nonconductive ceramic material. When the cathode electrode is energized, electrically nonconductive material is penetrated by the electric field, which attracts secondary electrons out of the cathode electrode, thereby increasing the cathode's efficiency as an emitter of secondary electrons. More specifically, cathode electrodes are used in a plasma addressing structure. The coating is formed by approximately 5 nm particles, each comprised of a fused matrix of conductive and nonconductive particles co-deposited with frit particles by either electrophoresis or "silk" screening. The coating is subsequently baked to fuse the frit and bond the electrophoretically deposited particles to the electrodes.

11 Claims, 6 Drawing Sheets

SPUTTER-RESISTANT CONDUCTIVE COATINGS WITH ENHANCED EMISSION OF ELECTRONS FOR CATHODE ELECTRODES IN DC PLASMA ADDRESSING STRUCTURE

CROSS REFERENCED TO RELATED APPLICATIONS

This application claims the benefit of U.S. Provisional application No. 60/023,418, filed Aug. 16, 1996, and is a continuation-in-part of application Ser. No. 08/870,763 filed on Jun. 6, 1997, now U.S. Pat. No. 5,783,906, which itself was a continuation of application Ser. No. 08/520,996 filed on Aug. 30, 1995, U.S. Pat. No. 5,536,812.

TECHNICAL FIELD

The invention relates to the formation of electrodes with specific properties and, more particularly, to the formation of sputter resistant cathode electrodes for a DC plasma addressing structure.

BACKGROUND OF THE INVENTION

Systems employing data storage elements include, for example, video cameras and image displays. Such systems employ an addressing structure that provides data to or retrieves data from the storage elements. One system of this type to which one embodiment of the present invention is particularly directed is a general purpose flat panel liquid crystal display whose storage or display elements store light pattern data. Flat panel-based display systems present a desirable alternative to the comparatively heavy, bulky, high-voltage cathode-ray tube-based systems.

A typical flat panel liquid crystal display comprises liquid material contained between two glass panels that are separated by a few microns and sealed together at their edges. The viewing area defined by this structure is divided into a multiplicity of display elements or "pixels." The optical characteristic of each pixel are determined by the electrical potential placed across the thickness of the liquid crystal material at the pixel location ("pixel gradient"). A pair of transparent electrodes, deposited onto the interior surface of each glass panel at each pixel, face each other across this thickness and form a capacitor. These terminals allow each pixel gradient and the resultant pixel optical characteristics to be independently manipulated. The pixels are spaced far enough apart from one another so that a first pixel gradient will not significantly affect the pixel gradients of the neighboring pixels.

Various schemes have been devised for allowing each pixel gradient to be set independently. In currently available active matrix liquid crystal arrays there is, generally, a thin film transistor ("TFT") connected to the pixel capacitor at every pixel. This TFT is typically strobed "on" by a row driver line at which point it will receive a value from a column driver line. This value is stored on the pixel capacitor until the next row driver line strobe. This method requires over 250,000 TFTs for a monochrome 512×512 pixel display and more than 750,000 TFTs for a color display. Because the failure of a single TFT is noticeable to a viewer, the requirement of having a TFT for each pixel drives up the cost of the display.

U.S. Pat. No. 4,896,149 describes the construction and operation of an alternative type of active matrix liquid crystal array, named a "plasma addressable liquid crystal" or "PALC" display. This technology avoids the cumbersome and restrictive use of a thin film transistor for every pixel. As in other flat panel displays, liquid crystal material is contained between two closely spaced glass panels. Each pixel is formed by a small area (typically on the order of a 0.25 square millimeter) of the liquid crystal material positioned between a first surface of a thin, impermeable dielectric barrier ("the barrier"), which comprises one of the two closely spaced glass panels and a photo-patterned conductive surface formed onto the other glass panel. Contacting a second surface of the barrier, which is opposed to the first surface, is a gaseous medium comprising a gas stored in a channel. The gaseous medium may be selectively switched from a nonionized, electrically nonconductive state to an ionized conductive plasma state through the application of a sufficient electrical potential ("channel potential") between opposed cathode and anode running the length of the channel. Removal of this potential causes the gaseous medium to return to an electrically nonconductive state.

When a sufficient electrical potential is applied between anode and cathode, electrons emitted from the cathode ionize gas atoms which then impinge back on the cathode and create more electrons in a rapidly avalanching process that renders the gas conductive, and a plasma quickly develops along the entire channel. This occurs within a microsecond or so after potential is applied. Both cathode and anode are then switched to ground potential and then as the plasma decays in the next several microseconds, the plasma decay processes return all of the surfaces of the channel including the second surface of the barrier to ground potential regardless of the potential they may have had before or during plasma operation.

Therefore, in this state only the pixel's liquid crystal material and thin dielectric barrier separate the conductive surface from ground. Consequently, the potential drop of a pixel is set to a proportion of the difference in electrical potential between the conductive surface and ground. This freezes the pixel gradient in place without regard to the subsequent electrical potential changes of the conductive surface.

Viewed on a larger scale, a PALC display includes a set of channels formed in or on an insulating plate and containing an ionizable gas under a top plate that contacts the tops of the ribs forming the channels and is sealingly connected around the periphery to the insulating plate. Plasma channels are horizontal in these displays, and electrodes are vertical. Each channel defines a row of pixels. Strips of pixel width transparent and electrically conductive material (typically indium tin oxide) extending perpendicularly to the channels face the array of channels across the liquid crystal material. Each strip defines a column of pixels. During operation the channels are sequentially rendered conductive, one at a time. Each time a channel is so rendered, the desired pixel gradients for the pixels of the corresponding row are set by the introduction of an appropriate electrical potential onto each of the conductive strips. This operation occurs many times per second for each channel while the display is in operation.

Parallel electrodes extend along the length of each channel at opposed sides. To avoid differences in electrical potential along the length of the channel cathode during the ionization of the gaseous medium, it is desirable that the resistance per unit length of the electrodes be no more than 2 ohms per centimeter (5 ohms per inch). To achieve this small value of resistance per unit length despite the tiny cross sectional area that is available for the electrodes, highly electrically conductive metals such as gold, silver, copper, or aluminum are used.

Because they are costly, gold and silver are undesirable despite their minimal oxidation during the one hour bake in standard atmosphere that is part of the PALC display fabrication process. Copper oxidizes considerably in this bake and loses conductivity. Aluminum, unfortunately, is less electrically conductive than would be ideal. Copper that is coated with a lower conductivity but oxidation resistant metal, such as chromium or palladium or nickel, provides an electrode of uniformly low resistance per unit length that is sufficiently resistant to oxidation.

In an alternative prior art structure a flat substrate is provided. An odd number of strips of nickel and glass frit particles are deposited on this substrate by way of a screen printing process. First portions of a fine mesh screen are rendered nonporous. The screen is placed over the substrate and a paste of nickel and glass particles suspended in a binder are pressed onto the screen, passing through the porous regions but being blocked by the nonporous regions. The product of this process is baked in air, driving off the organic binder and leaving a deposit of nickel and glass particles that is about 25 microns (1 mil) thick.

In this instance a series of strips of glass and nickel material are formed. To achieve the desired resistance per unit length of electrode, this process may be repeated one or more times to make a thicker and more conductive electrode.

Subsequently, by way of the same process, about 6 layers of insulative material each about 15 microns thick are deposited on every odd strip, counting from either end. This structure defines a set of channels each having a glass and nickel strip extending along the channel center.

This center strip is controlled to be the cathode, whereas the channel defining nickel and glass strips on either side of each channel are controlled to be the anodes. Although the nickel-glass mixture is less conductive than copper or aluminum, the strips have a great enough cross sectional area to be adequately conductive so that they will bear a substantially uniform electrical potential relative to ground over their entire lengths.

Chromium, nickel, or other metals in general, however, if used as the exposed surface for a PALC cathode, are highly susceptible to sputter damage. Sputter damage happens when a positive ion, accelerated by the electric field established between the cathode and anode, collides with the cathode surface and causes an atom in the surface to be dislodged. This process is harmful to the display device, causing the surfaces of the plasma channels to be coated with material which has been sputtered off the cathode. This eventually reduces the panel transparency and eventually increases the conductivity of the second surface of the barrier thus degrading the operating efficiency of the channels, thereby ruining the display.

To avoid sputter damage, the exterior layer of a PALC cathode should be a good emitter of "secondary electrons," and have a high heat of sublimation. "Secondary electrons" are electrons which may be emitted from the cathode in response to the discharge of energy from a nearby (on an atomic scale) "metastable" atom caused by the collapse of a "primary electron" from a high-energy outer valence level to a lower energy valence level. (The presence of an electron that has been elevated to a high-energy outer valence level and is quantum mechanically forbidden to return to a lower energy state is the defining characteristic of a metastable atom.) A similar process with ionized atoms also can cause secondary electrons to be emitted from the cathode and at the same time neutralize the ion.

The probability of a secondary electron being emitted by some cathode surfaces in response to an ion or metastable atom collision is higher than with others. The higher the emission probability is for a given surface, the fewer the number of ions or metastable atoms that are needed to produce sufficient secondary electrons to sustain the plasma. Thus a lower anode to cathode potential is needed to cause the gaseous medium to transition the plasma. This lowered channel potential reduces the kinetic energy imparted to gas ions, which therefore collide with the cathode at a lower speed. Hence, there is a lessened probability of sputter damage at each collision.

"Heat of sublimation" is the amount of energy required to separate an atom from a solid substance (in this case the exterior layer of the cathode). Therefore, a high heat of sublimation equates to a lower probability of sputter damage at each collision.

The exterior coating of the cathode must also not be susceptible to oxidation during the one hour air bake that is an integral part of the PALC display production process.

In addition, any arrangement of materials used to form a cathode sufficient to solve the problems described above would be impracticable unless an economical process is available for realizing the arrangement.

Parent application Ser. No. 08/520,996, filed Aug. 20, 1995, now abandoned which is assigned to the same assignee as the present application, teaches the formation of PALC display cathodes by the electrophoretic deposition of rare earth hexaboride particles over a previously applied conductive and oxidation resistant lead running the length of the channel. This represents a major technological advance, producing a cathode that is sputter resistant and is a good emitter of secondary electrons in comparison with the prior art.

An even greater advantage could theoretically be gained, however, if the coating were electrically nonconductive. To understand why this is so, it is helpful to understand the plasma formation process on an atomic level. When the cathode is energized, it begins to emit electrons in response to ion or metastable atom collisions. Each emitted electron may then cause the formation of a positive ion by colliding with a gas atom and dislodging an electron. Alternatively, an electron and atom collision may form a metastable atom by exciting an electron into an excited energy state from which it is quantum mechanically forbidden to transition to a lower energy state without external perturbations.

The positive ions will be drawn toward the cathode by the electromagnetic field. The metastable atoms will move randomly and may approach the cathode by chance. In either case, when the metastable atom or ion approaches near to the cathode (on an atomic scale), a process known as "Auger excitation," will de-excite the ion or metastable atom and simultaneously excite an electron in the cathode to a higher energy state. If the potential energy released by the ion or metastable is sufficiently large, an electron in the cathode will be excited to a state above "vacuum level."

If the cathode surface is a conductive material, the electric field between cathode and anode will not penetrate the cathode surface. As a result, the excited electron will not be attracted to the cathode surface and be emitted. There is some probability that it still might migrate to the surface due its tendency to move at random so that it might by chance reach the surface and thereby be emitted before it decays to a lower energy state.

If the electrically excited electron were located in an electrically nonconductive region, however, the electric field between cathode and anode could penetrate the region and would attract the electron to the cathode surface where it would be emitted into the plasma. An electrically nonconductive region, which permits the electric field to attract electrons to the surface, thereby causes the cathode to emit more electrons and more efficiently convert the inert gas into a plasma. In addition, many nonconductive materials, MgO and $Al_2O_3$ in particular, are very sputter resistant.

The problem with an electrically nonconductive cathode region, however, is that electrons cannot flow through such a region to replace the electrons expelled, and thus these regions quickly become charged and repel electrons from their surface. This problem has been addressed by U.S. Pat. No. 4,663,559 ("Christensen") granted to Christensen which teaches that electrically nonconductive particles having a diameter on the order of 3.5 nm be interspersed with conductive particles on the surface of an electron emitter in a field emission device. The field of application of Christensen is very different from the field of application of the present invention. The cathode of a field emission device is typically contained in a vacuum. In addition, the cathode of a field emission device is typically cone shaped. The tip of the cone, because of its small, compact volume may be subjected to an electric field that is so intense that it bends the energy bands of the material used to a lower energy level. When a nonconductive material is used, as taught in Christensen, the valence bands of the lowest energy electrons can be bent so that at the surface of the tip of the cone, they are below the vacuum level. These electrons are instantaneously emitted. If the nonconductive material is less than about 3.5 nm away from a conductive material, they may be replaced by tunneling and emitted again.

The cathode of a PALC display, however, is contained in a channel filled with a gaseous medium, increasing the potential severity of sputter damage. Because of this the high voltages used for field emission devices may not be used for a PALC display, removing the possibility of bending any of the valence bands of the cathode material electrons below the vacuum level. Also the problems associated with depositing material onto a PALC display cathode are different from those of depositing material onto the small and compact tip of a field emission device. In addition, Christensen fails to completely disclose a method of manufacturing his device.

The use of electrically nonconductive particles that are the order of 3.5 nm in diameter permits replenishment by means of quantum mechanical "tunneling" of the electrons from the conductive particles of the cathode. "Tunneling" is a phenomenon by which an electron in one low energy region that is separated from another low energy region by an intervening thin potential barrier can instantaneously appear in the other low energy region. The probability of an electron tunneling declines exponentially as a function of the width of the intervening potential barrier. Therefore, the smaller the electrically nonconductive particle, the greater the probability that the positively charged region that is created by an electron emission will be neutralized by an electron that tunnels from an adjacent conductive cathode particle after emitting an electron into the gas.

SUMMARY OF THE INVENTION

It is therefore an object of the present invention to provide a PALC display having a sputter resistant cathode wherein the surface layer is speckled with electrically nonconductive spots, thereby enhancing the cathode's efficiency as a producer of secondary electrons.

An advantage of the present invention is that it provides a PALC display with an enhanced life expectancy in comparison with prior art PALC displays.

The present invention comprises a linear cathode having a first linear cathode portion that is conductive and nonoxidizing, the surface of which is speckled with nonconductive sputter resistant material. This structure allows the cathode to apply the gaseous medium of the PALC display channel by applying a "reduced voltage" across the gaseous medium. "Reduced voltage" in the context of this application refers to "voltage which is less than the voltage which heretofore had been necessary in order to achieve the ionization of the gaseous medium." A reduced voltage results in reduced sputter damage because it accelerates the ions of the gaseous material with a lesser force, thereby reducing their kinetic energy at the time they collide with the cathode.

In an alternative preferred embodiment, first particles of a refractory compound are electrophoretically deposited on the second layer. Subsequently, electrically nonconductive ceramic second particles having an average diameter of about 3.5 nm are deposited on top of the first particles.

Additional objects and advantages of this invention will be apparent from the following detailed description of preferred embodiments thereof which proceeds with reference to the accompanying drawings.

DETAILED DESCRIPTION OF PREFERRED EMBODIMENTS

Figure 1:
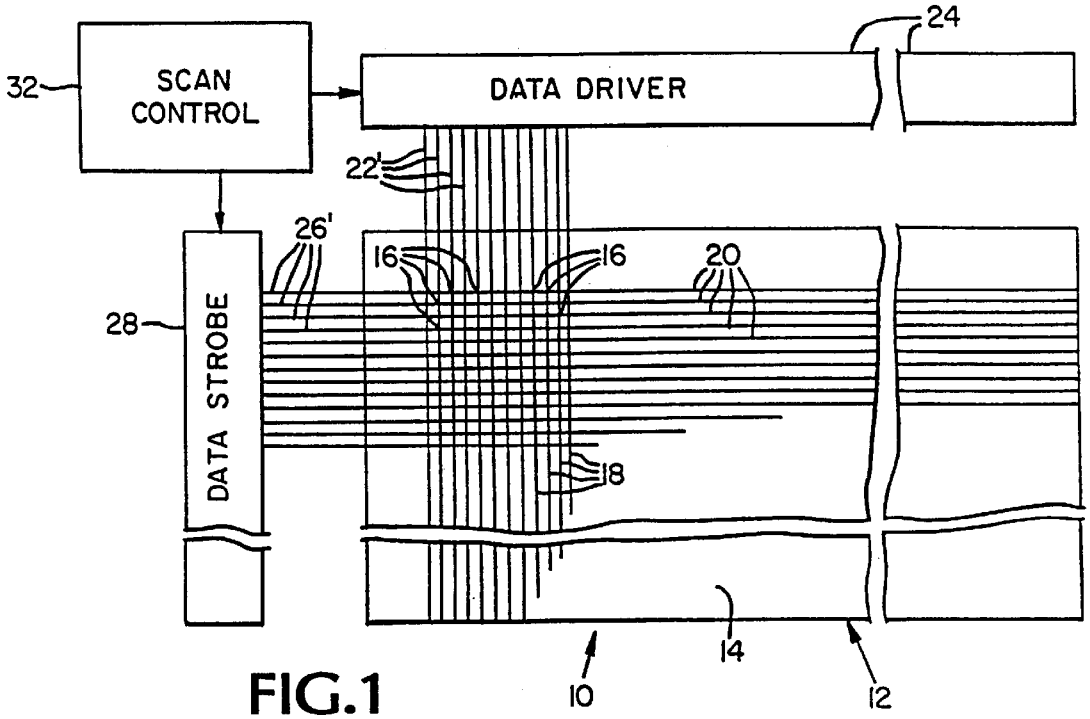
FIG.1 (PRIOR ART)
FIG. 1 is a diagram showing a frontal view of the display surface of a prior art display panel and associated drive circuitry of a plasma addressing structure in which the present invention could be employed.
Figure 2:
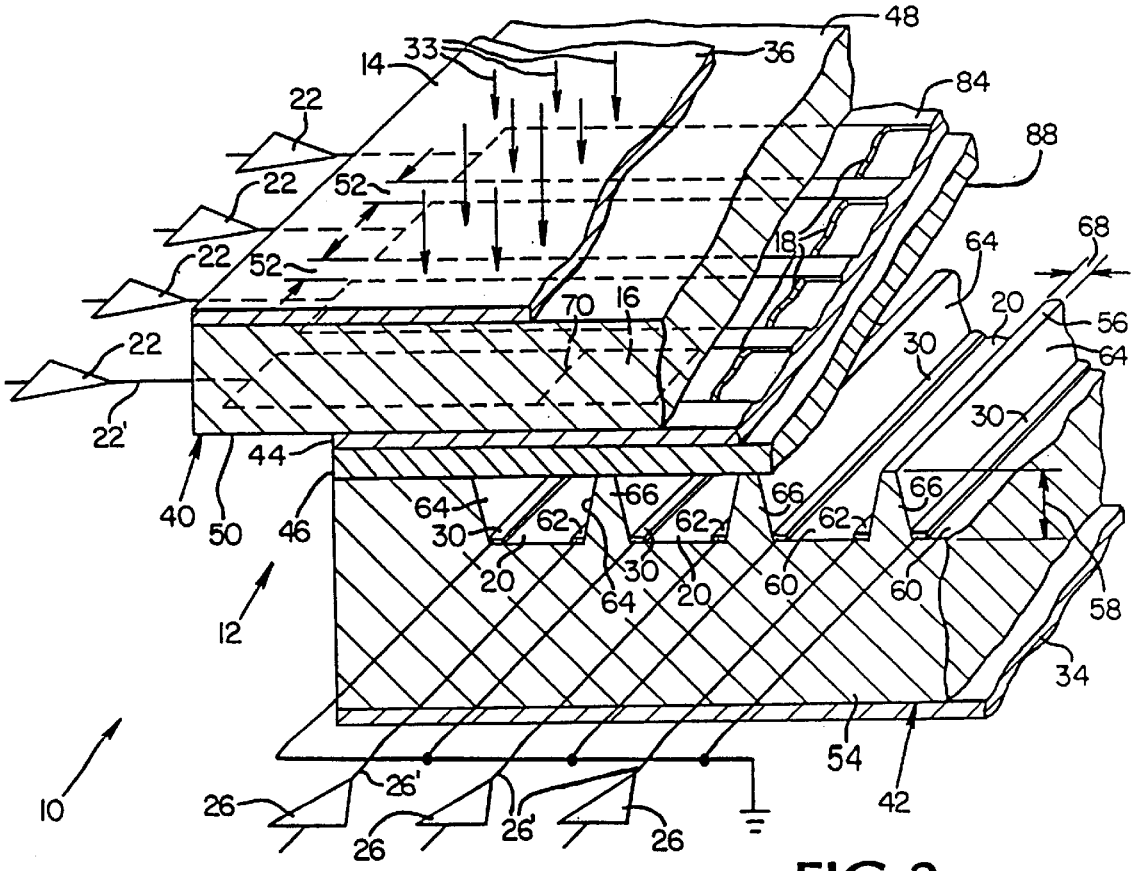
FIG.2 (PRIOR ART)
FIG. 2 is an enlarged fragmentary isometric view showing the layers of structural components forming the prior art display panel as viewed from the left side in FIG. 1.
Figure 3:
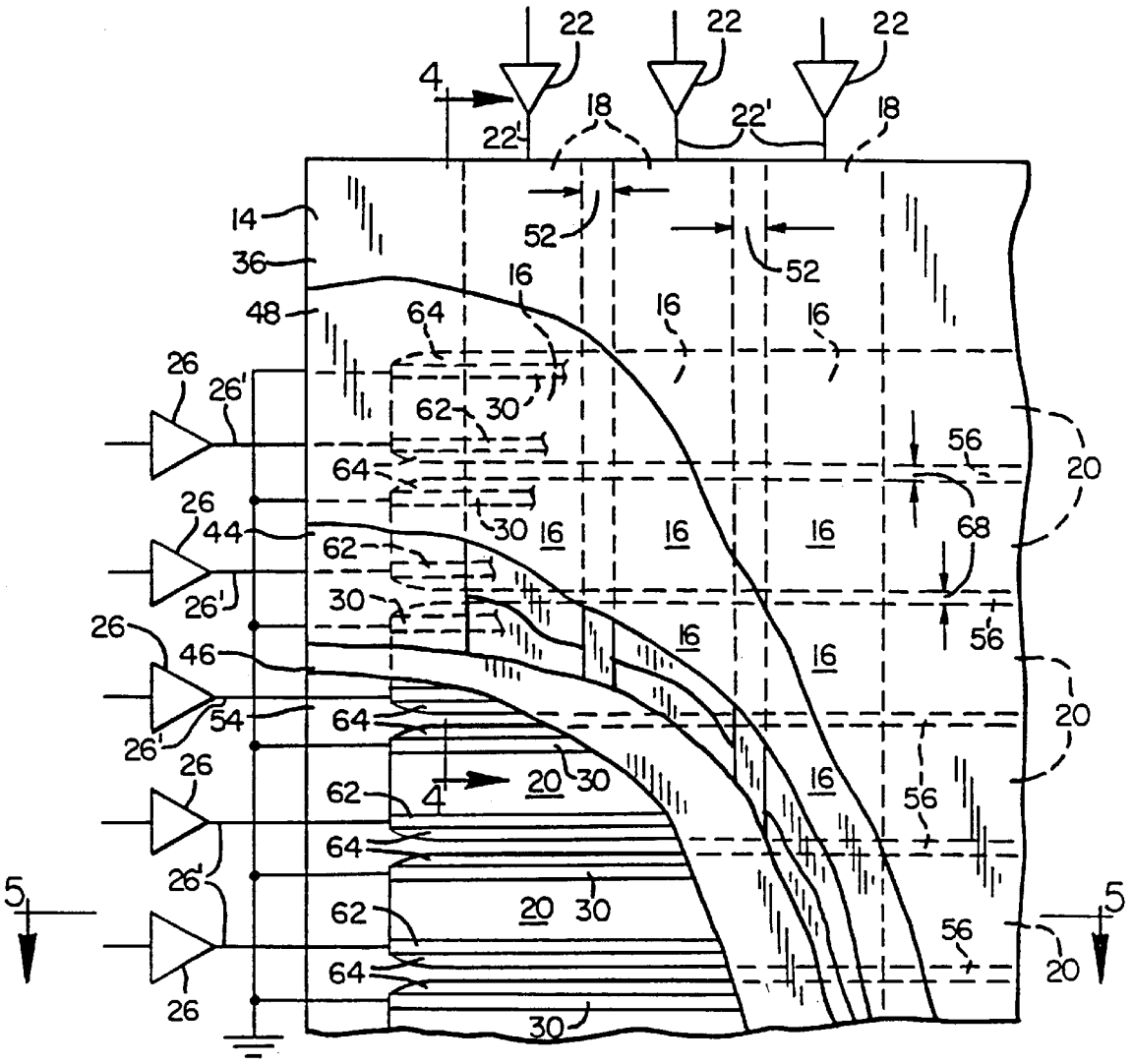
FIG.3 (PRIOR ART)
FIG. 3 is an enlarged fragmentary frontal view with portions broken away to show different depthwise views of the interior of the prior art display panel of FIG. 2.

FIGS. 1–3 show a flat panel display system 10, which implements a prior art plasma addressing structure that includes a set of elongated cathodes 62 with respect to which the present invention may be implemented. With reference to FIGS. 1–3, flat panel display system 10 comprises a display panel 12 having a display surface 14 that contains a pattern formed by a rectangular planar array of nominally identical data storage or display elements ("pixels") 16 mutually spaced apart by predetermined distances in the vertical and horizontal directions. Each display element or pixel 16 in the array represents the overlapping intersection of a thin, narrow vertically-oriented electrode 18 and an elongated, narrow horizontally-oriented plasma channel 20. (The electrodes 18 are hereinafter referred to as "column electrodes 18.") All of the display elements or pixels 16 of a particular plasma channel 20 are set simultaneously when the inert gas in the plasma channel is sufficiently ionized. Each pixel is set to a fixed proportion the potential gradient between the column electrode and ground at this time.

The widths of column electrodes 18 and plasma channels 20 determine the dimensions of display elements 16, which are of rectangular shape. Column electrodes 18 are deposited on a major surface of a first electrically nonconductive, optically transparent substrate, and plasma channels 20 are inscribed in a major surface of a second electrically nonconductive, optically transparent substrate. Alternatively, each plasma channel 20 is defined by two parallel walls that are built up on the second substrate.

Skilled persons will appreciate that certain systems, such as a reflective display of either the direct view or projection type, would require that only one of the substrates be optically transparent.

Column electrodes 18 receive data drive signals of the analog voltage type developed on parallel output conductors 22' by different ones of the output amplifiers 22 (FIGS. 2 and 3) of a data driver or drive circuit 24, and plasma channels 20 receive data strobe signals of the voltage pulse type developed on output conductors 26' by different ones of the output amplifiers 26 (FIGS. 2 and 3) from the output of strobe circuit 28. Each of the plasma channels 20 includes a reference electrode 30 (FIGS. 2 and 3) to which a reference potential common to each channel 20 and data strobe 28 is applied.

To synthesize an image on the entire area of display surface 14, display system 10 employs a scan control circuit 32 that coordinates the functions of data driver 24 and data strobe 28 so that all columns of display elements 16 of display panel 12 are addressed row by row in row scan fashion. Display panel 12 may employ electro-optic materials of different types. For example, if it uses such a material that changes the polarization state of incident light rays 33 (FIG. 3), display panel 12 is positioned between a pair of light polarizing filters 34 and 36 (FIG. 2), which cooperate with display panel 12 to change the luminance of light propagating through them. The use of a scattering liquid crystal cell as the electro-optic material would not require the use of polarizing filters 34 and 36, however. A color filter (not shown) may be positioned within display panel 12 to develop multi-colored images of controllable color intensity. For a projection display, color can also be achieved by using three separate monochrome panels 10, each of which controls one primary color.

With particular reference to FIGS. 2 and 3, display panel 12 comprises an addressing structure that includes a pair of generally parallel electrode structures 40 and 42 spaced apart by a layer 44 of electro-optic material, such as a nematic liquid crystal, and a thin layer 46 of a dielectric material, such as glass, mica, or plastic. Electrode structure 40 comprises a glass dielectric substrate 48 that has deposited on its inner surface 50 column electrodes 18 of indium tin oxide, which is optically transparent, to form a striped pattern. Adjacent pairs of column electrodes 18 are spaced apart a distance 52, which defines the horizontal space between next adjacent display elements 16 in a row.

Electrode structure 42 comprises a glass dielectric substrate 54 into whose top surface 56 multiple plasma channels 20 of trapezoidal cross section with rounded side walls are inscribed. Plasma channels 20 have a depth 58 measured from top surface 56 to a base portion 60. Each one of the plasma channels 20 has an anode electrode 30 and cathode electrode 62, both of which are thin and narrow. Each of these electrodes extends along the intersection of base portion 60 and one out of a pair of inner side walls 64. Walls 64 diverge in the direction away from base portion 60 toward inner surface 56.

The anode electrodes 30 of the plasma channels 20 are connected to a common electrical reference potential, which can be fixed at ground potential as shown. The cathode electrodes 62 of the plasma channels 20 are connected to different ones of the output amplifiers 26 (of which three and five are shown in FIG. 2 and FIG. 3, respectively) of data strobe 28. To ensure proper operation of the addressing structure, the anode electrodes 30 and cathode electrodes 62 preferably are connected to the electrical reference potentials and the amplified outputs 26' of data strobe 28, respectively, on opposite edges of display panel 10.

The sidewalls 64 between adjacent plasma channels 20 define a plurality of support structures 66 whose top surfaces 56 support layer 46 of dielectric material. Adjacent plasma channels 20 are spaced apart by the width 68 of the top portion of each support structure 66, which width 68 defines the vertical space between next adjacent display elements 16 in a column. The overlapping regions 70 of column electrodes 18 and plasma channels 20 define the dimensions of display elements 16, which are shown in dashed lines in FIGS. 2 and 3. FIG. 3 shows with better clarity the array of display elements 16 and the vertical and horizontal spacings between them.

The magnitude of the voltage applied to column electrodes 18 specifies the distance 52 to promote isolation of adjacent column electrodes 18. Distance 52 is typically much less than the width of column electrodes 18. The inclinations of the side walls 64 between adjacent plasma channels 20 specify the distance 68, which is typically much less than the width of plasma channels 20. The widths of the column electrodes 18 and the plasma channels 20 are typically the same and are a function of the desired image resolution, which is specified by the display application. It is desirable to make distances 52 and 68 as small as possible. In current models of display panel 12, the channel depth 58 is approximately one-half the channel width.

Each of the plasma channels 20 is filled with an ionizable gas or gaseous mixture, often a mixture of inert gases, but combinations of reactive and inert gases may be used. Layer 46 of dielectric material functions as an isolating barrier between the ionizable gas or gaseous mixture contained within channel 20 and layer 44 of liquid crystal material. The absence of dielectric layer 46 would, however, permit either the liquid crystal material to flow into the channel 20 or the ionizable gaseous mixture to contaminate the liquid crystal material. Dielectric layer 46 may be eliminated from displays that employ a solid or encapsulated electro-optic material.

Figure 4A:
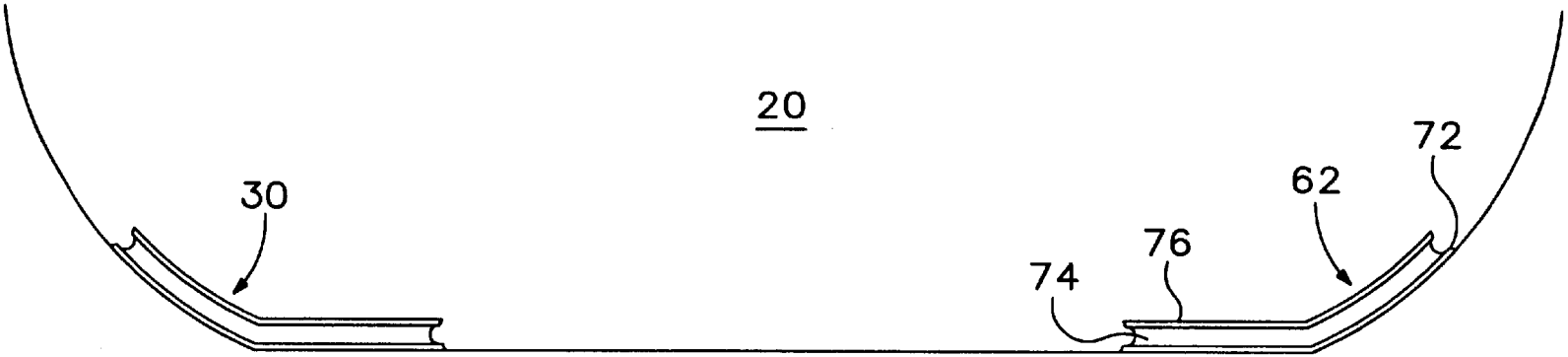
FIG.4A PRIOR ART
FIG. 4A is an enlarged cross-sectional view of a channel in a plasma addressing structure showing the cross-section of a prior art cathode electrode (shown enlarged relative to scale, for clarity of presentation)

FIG. 4A shows in greater detail prior art plasma channel 20 formed in glass substrate 54. Channel 20 is 450 microns wide at the top, 200 microns deep, and approximately 300 microns wide at the bottom. Cathode electrode 62 is about 75 microns wide and has a 0.2 micron thick bottom layer 72 of chromium for good adhesion to glass substrate 54, an approximately 2.0 micron thick layer of copper 74 for good conductance, and a 0.2 micron thick top layer 76 of chromium for sealing the copper layer 74 against oxidation. Skilled persons will appreciate that copper is highly electrically conductive and chromium is electrically conductive and gaseous-medium-impermeable. Anode electrode 30 may have an appearance and structure generally similar to that of cathode electrode 62.

Figure 4B:
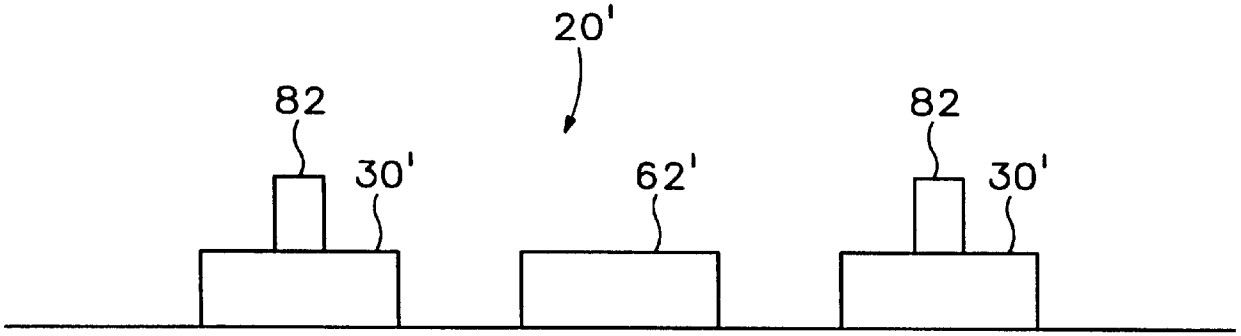
FIG.4B PRIOR ART
FIG. 4B is an enlarged cross-sectional view of an alternative prior art channel in a plasma addressing structures with the cathode and anode electrodes (shown enlarged relative to scale, for clarity or presentation)

FIG. 4B shows an alternative prior art PALC channel 20' having a flat substrate 77 and in which the channel is defined by two anodes 30' flanking the channel and each bearing an insulating ribbon 82 which further defines the channel. A cathode 62' extends directly along the center of the channel. Both the anodes 30' and the cathodes 62' are comprised of nickel or other highly conductive metal and glass frit particles which have been deposited by a silk-screen technique. The insulating ribbons 82 have also been deposited by a silk-screen technique.

Figure 6:
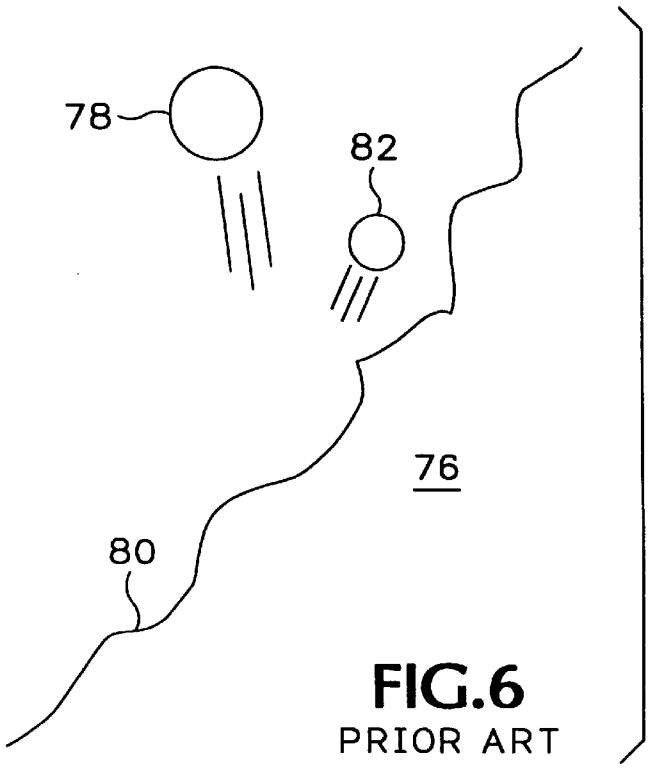
FIG.6 PRIOR ART
FIG. 6 is a greatly magnified cross-sectional view of the surface of the prior art cathode of FIG. 4A after the positive ion has collided with it.
Figure 5:
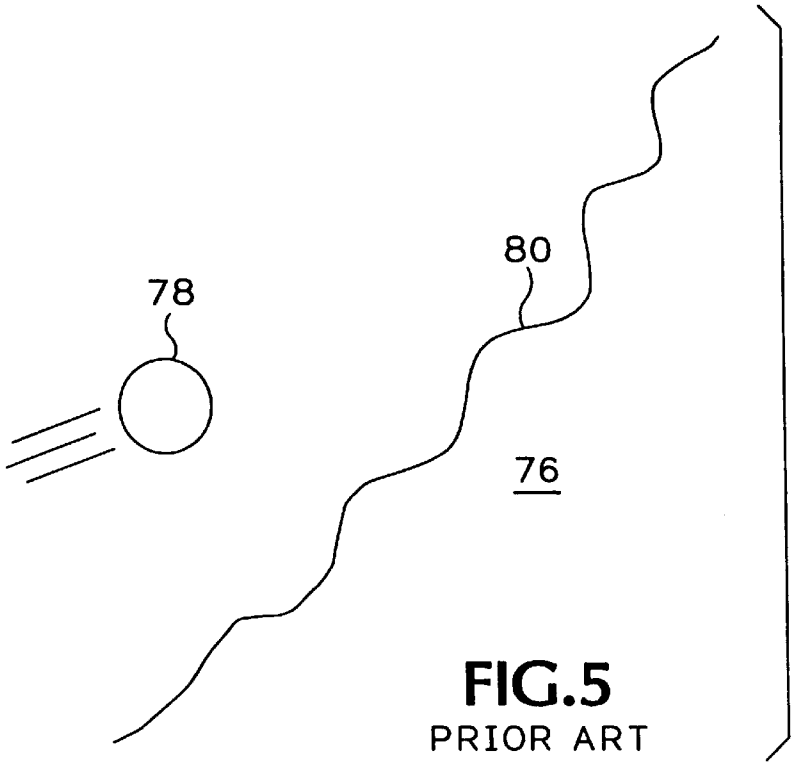
FIG.5 PRIOR ART
FIG. 5 is a greatly magnified cross-sectional view of the surface of the prior art cathode of FIG. 4A with a positive ion propagating toward it.

FIGS. 5 and 6 show that top chromium layer 76 is susceptible to sputter damage. In FIG. 5, an ion 78 of inert gas is shown propagating toward the wavy surface 80 of top layer 76 of chromium in prior art cathode 62. FIG. 6 shows the results of the collision of ion 78 with surface 80 from which a chromium atom 82 has been dislodged and ion 78 has been deflected. Over time the dislodged chromium atoms 82 become deposited in increasing number on the sides and bottom of channel 20 and on the cover, turning a transmissive display system 10 dark and destroying its usefulness. Further, the chromium deposited on sheet 46 eventually renders its surface sufficiently conductive that it will no longer store different amounts of charge on various pixels 16 so that the lines of the display become uniformly gray.

Figure 7:
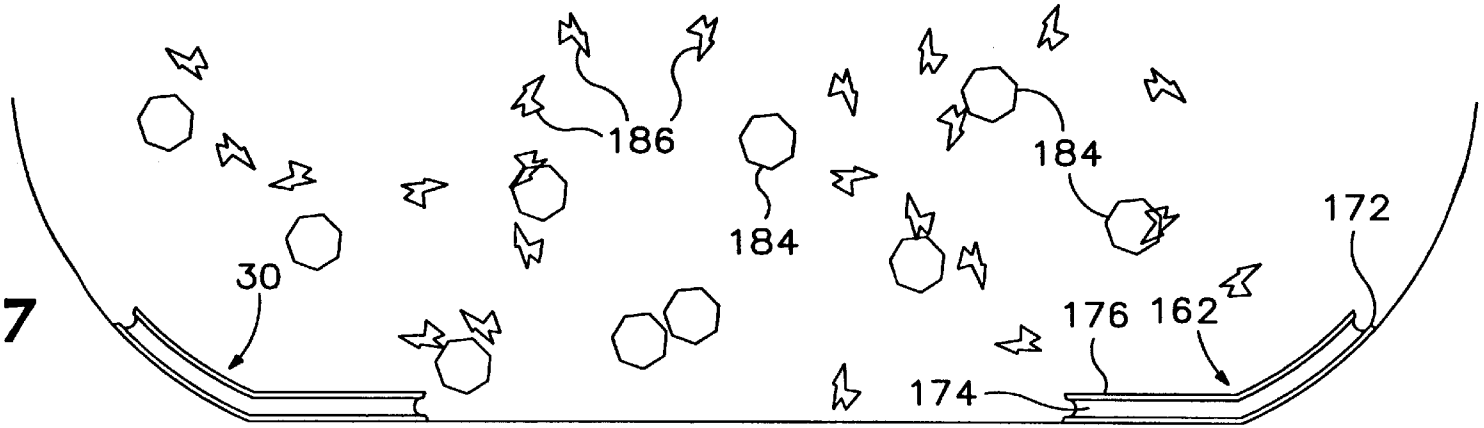
FIG. 7 is a greatly expanded cross-sectional view of a channel in a PALC display undergoing the first stage of an electrophoretic process according to a first preferred embodiment of the present invention, with the refractory compound and frit particles (shown enlarged relative to scale, for clarity of presentation)

FIG. 7 is a cross-sectional view of a plasma channel 120 display undergoing an electrophoresis process conducted according to the present invention. In FIG. 7, like components are labeled with the same reference numerals as those in FIGS. 1–6, except that 100 has been added to each reference numeral. Electrophoresis is a well known technique, and the electrophoresis techniques used in this invention are standard and known to skilled persons.

Positively charged particles 184 of typically about 4.0 microns in diameter, shown enlarged relative to scale for clarity of presentation, are suspended in a bath of a dielectric liquid such as isopropyl alcohol. Each particle 184 is formed of a cermet mesh in which an electrically nonconductive ceramic compound is interspersed with a metallic compound. Typically, the electrically nonconductive ceramic compound comprises MgO, $SiO_2$, $Al_2O_3$, diamond, or some combination of two or three of these compounds. The metallic compound typically comprises $CrSi_3$ or a rare earth hexaboride. The following method is used to form particles 184. First, a particle available of an electrically nonconductive ceramic compound and a metallic compound are fused together into a block. The cermet mesh that results from this process is commercially available from material supply houses. This mesh is ground into particles 184. Frit particles 186, also positively charged, are shown similarly suspended. A negative potential applied to cathode 162 draws these positively charged particles toward cathode 162. (Typically the same negative potential is applied to all electrodes in the channel during deposition.)

Figure 8:
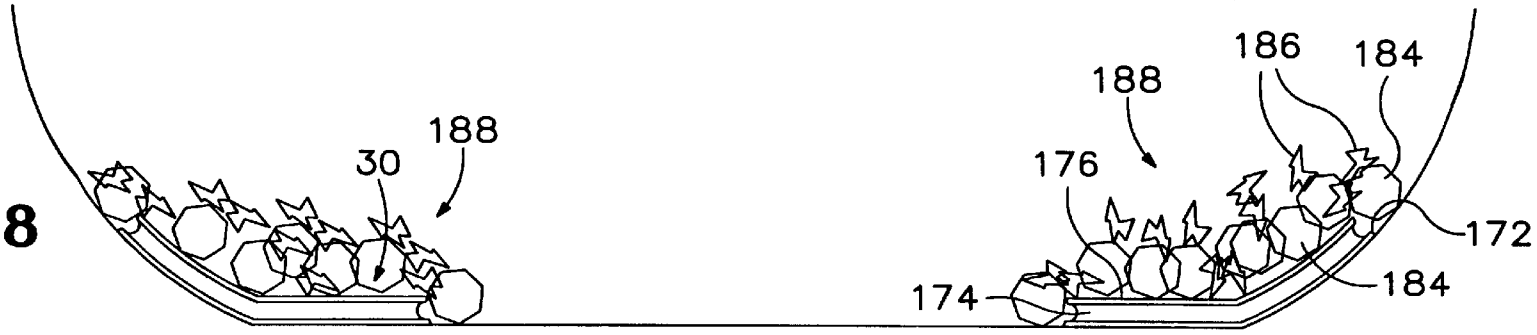
FIG. 8 is a greatly expanded cross-sectional view of the channel and particles of FIG. 7 after the completion of electrophoresis.

FIG. 8 shows a cross-sectional view of the channel of FIG. 7 after the completion of electrophoresis. On top of layer 176 of chromium, a new layer 188 of cermet matrix particles 184 is intermixed with frit particles 186. This new layer is approximately 10.0 microns thick. Because top layer 188 of particles is discontinuous and is not air tight, layer 176 of chromium is desirable to prevent oxidation of copper layer 174 during the one-hour bake in air. Layer 176 of chromium extends along the entire length of cathode 162.

Figure 9:
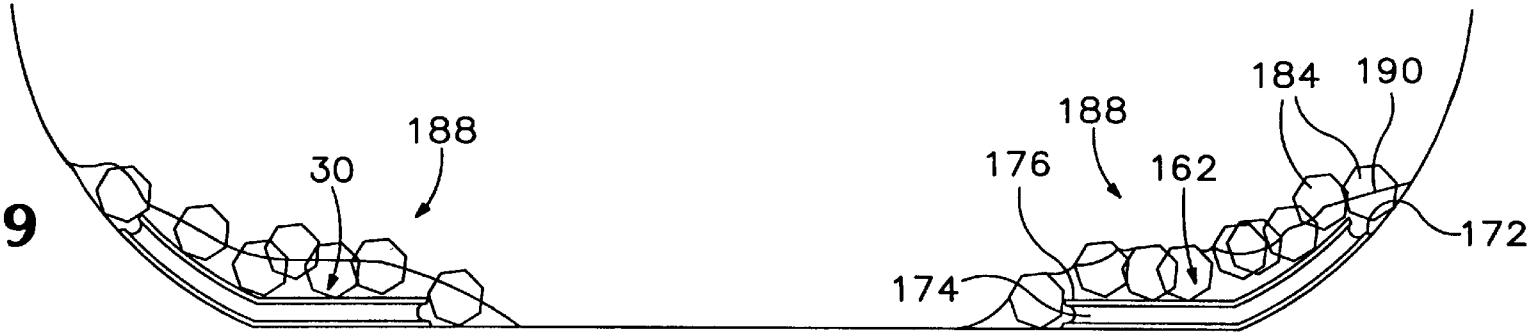
FIG. 9 is a greatly expanded cross-sectional view of the channel and particles of FIG. 7 after a one hour air bake and wherein the frit particles have fused.

FIG. 9 shows a cross-sectional view of the channel of FIG. 7 after the completion of the air bake. The frit particles 186 (FIG. 8) have fused into a layer of glass 190, thereby cementing the refractory particles 184 to the electrode surface and to one another.

A coating as described above may be applied to the prior art electrode shown in FIG. 4B. This may be done either through a silk screening process or by way of electrophoresis.

Figure 10:
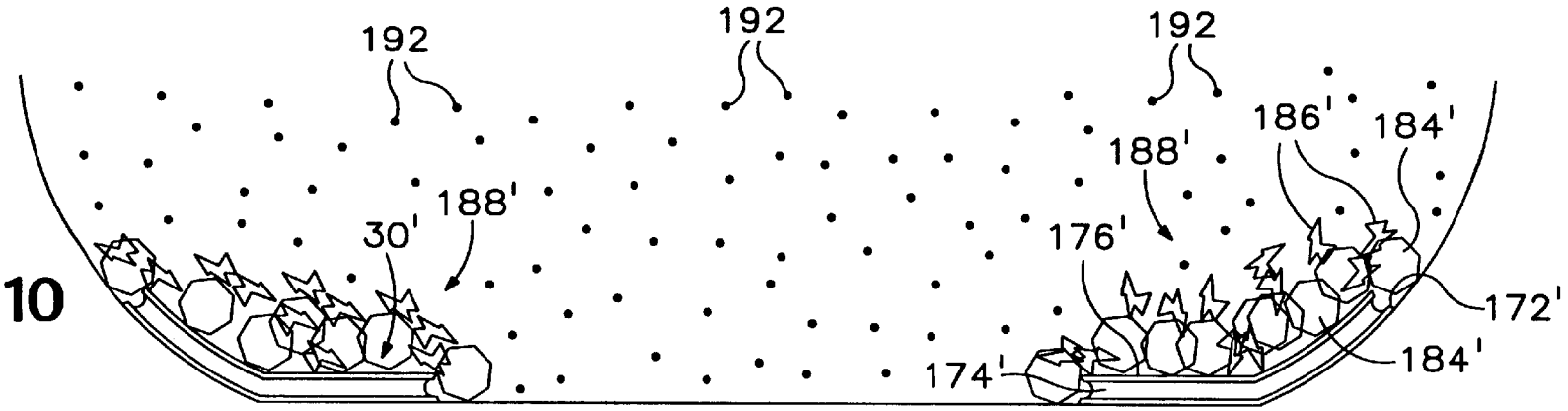
FIG. 10 is a greatly expanded cross-sectional of a channel in a PALC display undergoing the second stage of an electrophoretic process according to a second preferred embodiment of the present invention, with the refractory compound, ceramic compound and frit particles (shown enlarged relative to scale, for clarity of presentation)
Figure 11:
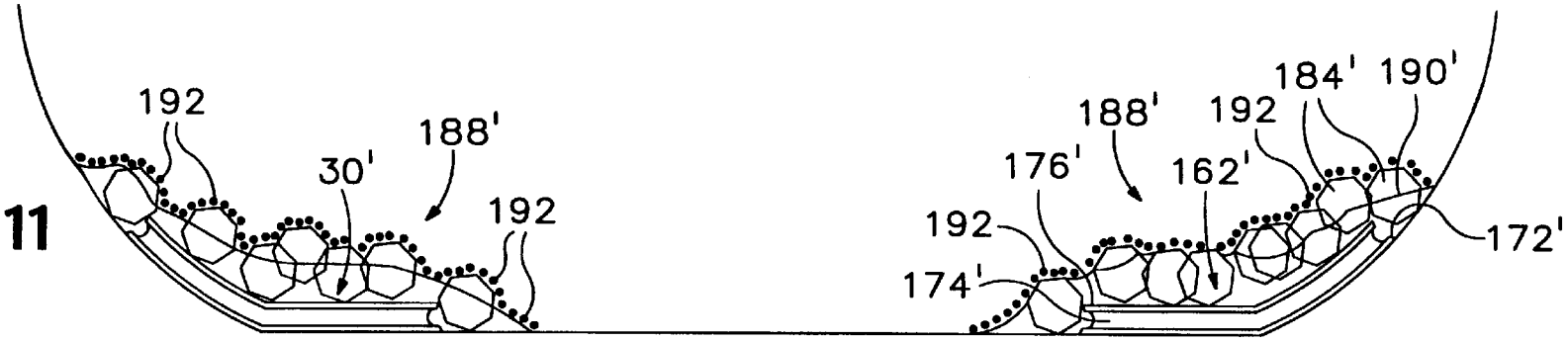
FIG. 11 is a greatly expanded cross-sectional view of the channel and particles of FIG. 7 after the completion of both electrophoresis and a one hour bake.

In FIG. 10, a channel similar to that of FIG. 7, but in which an alternative preferred embodiment of the present invention is represented. In this embodiment, particles 184 of FIG. 7 have been replaced with particles 184' which comprise a refractory compound such as a rare earth hexaboride or $CrSi_3$. All other elements which are designated with a primed FIG. 7 reference number are the same as the corresponding FIG. 7 element. FIG. 10 shows an additional step in the process in which electrically nonconductive ceramic particles 192, typically comprising MgO, $SiO_2$, $Al_2O_3$, or diamond are electrophoretically deposited on top of previously deposited layer 188'. FIG. 11 shows the finished result of the process of FIG. 10 with particles 192 lightly interposed over the surface over layer 188'.

The resultant surface is comprised of particles of a refractory compound speckled with nonconductive spots. Optimally the spots should about 3.5–5.0 nm in diameter so that electrons that are driven out may be replaced by tunneling. Larger spots would also work, however, as those regions of the spots that are within about 20 angstroms of refractory compound material could be replaced by tunneling. As each nonconductive spot is generally an efficient emitter of secondary electrons, it is beneficial to have a high density of such spots. A suitable spot size is that which provides at least one percent, and preferably 50percent, of the surface area of the spot within ten angstroms of the refractory compound.

Both of the embodiments shown operate according to the same set of principles. Electrically nonconductive material will emit secondary electrons more efficiently than conductive material because in electrically nonconductive material secondary electrons after being elevated to or above the vacuum level through Auger excitation will be drawn toward the cathode surface by the electric field created by the anode-to-cathode bias. The electrically nonconductive particles are preferably on the order of 35–50 angstroms in diameter, however, so that the electrons which are drawn out may be replaced by electrons from the adjacent conductive material through tunneling.

Refractory materials are characterized by high heats of sublimation so that impinging gaseous medium ions colliding with them tend not to sublimate or dislodge molecules of the refractory materials. In addition, the refractory compounds used are chosen for their oxidation resistance during the one-hour air bake that is part of the manufacturing process.

Because the electrically nonconductive ceramic particles are excellent emitters of electrons, it is possible to operate the PALC display with a lower potential gradient applied between its anode and its cathode. The gaseous medium may be converted to a plasma by applying an electrical potential difference between anode and cathode with a nontransient magnitude of less than 200 volts. Under these operating conditions, a less intense electric field accelerates the ions, thereby leading to lower ion energies and less sputter damage.

Many refractory compounds or combination of refractory compounds will work in the current invention. Because the electrically nonconductive ceramic particles are such excellent emitters of secondary electrons, the refractory compound may be chosen to maximize heat of sublimation without regard to the work function of the compound. $CrSi_3$ has a high heat of sublimation and is, therefore, a favored candidate for this use. Also of interest, however, is the group of rare earth hexaborides, particularly $LaB_6$, $YB_6$, $GdB_6$, and $CeB_6$, all of which also have high heats of sublimation. Note that for purposes of this application, yttrium hexaboride ($YB_6$) is counted among the rare earth hexaborides. Although yttrium is not technically a member of the rare earth group of elements, it shares many of the characteristics of this group. Diamond that has been rendered semiconductive may also provide good performance in this application.

To determine the performance of a refractory compound, an experiment may be conducted in which the compound is used in the fabrication of the plasma electrodes of a PALC display and then the display is run to determine the length of operating time necessary to provoke a set level of sputter damage.

It will be obvious to those having skill in the art that many changes may be made to the details of the above-described embodiments of this invention without departing from the underlying principles thereof The scope of the present invention should, therefore, be determined only by the following claims.

We claim:

1. In an addressing structure for addressing a data element, the addressing structure including a substrate having a channel containing an ionizable gaseous medium, a data element that stores a data signal, and a cathode and an anode electrode both having a length and positioned within the channel, wherein a sufficiently large potential difference between the cathode and anode electrodes causes the ionizable gaseous medium to transition to a conductive plasma state from a nonionized state to provide an interruptible electrical connection between the data element and the electrical reference to selectively address the data element, the cathode comprising:

a conductive oxidation resistant linear portion substantially extending along the length of the channel; and a coating that extends along the length of and covers the cathode and that includes first and second interspersed component particles, the first component particles each having a size and comprised of at least one electrically conductive refractory compound, and the second component particles each having a size and comprised of an electrically nonconductive ceramic compound the sizes of the second component particles being substantially smaller than the sizes of the first component particles to form a coating surface that is speckled with spots of the second component particles to facilitate efficient secondary electron emission from the cathode and enable electron replacement by tunneling.

2. The structure of claim 1, in which the coating surface is speckled with the second component particles to form electrically nonconductive ceramic spots that are fine enough so that at least one percent of the surface area of the spots is within ten angstroms of the electrically conductive refractory compound.

3. The structure of claim 2, in which the coating surface is speckled with the second component particles to form electrically nonconductive ceramic spots that are fine enough so that at least 50 percent of the surface area of the spots is within ten angstroms of the electrically conductive refractory compound.

4. The cathode of claim 1, in which the coating surface that is speckled with spots of the second component particles comprised of an electrically nonconductive ceramic compound is formed from a multiplicity of the second component particles deposited in a random fashion over a layer of the first component particles comprised of at least one electrically conductive refractory compound.

5. The cathode of claim 1, in which the coating surface that is speckled with spots of the second component particles Is formed from a matrix of the first component particles comprised of at least one electrically conductive refractory compound interspersed with the second component particles comprised of an electrically nonconductive ceramic compound.

6. The cathode of claim 1, in which the electrically nonconductive ceramic compound is selected from a group consisting of MgO, $SiO_2$, and $Al_2O_3$.

7. The cathode of claim 1, in which the first component particles have been electrophoretically deposited.

8. The cathode of claim 1, in which the first component particles are deposited in a silk screening process.

9. The cathode of claim 1, in which the first component particles are held in place by a fused frit.

10. The cathode of claim 9, in which the fused frit is glass.

11. The cathode of claim 1, in which the electrically conductive refractory compound is selected from a group consisting of the rare earth hexaborides, $Cr_3Si$, and diamond.

* * * * *